US010180064B2

(12) United States Patent
Feng et al.

(10) Patent No.: US 10,180,064 B2
(45) Date of Patent: Jan. 15, 2019

(54) SYSTEM FOR SAMPLING FROM FORMATION WHILE DRILLING

(71) Applicants: China National Offshore Oil Corporation, Beijing (CN); China Oilfield Services Limited, Langfang (CN)

(72) Inventors: Yongren Feng, Langfang (CN); Zhongli Bao, Langfang (CN); Qiang Yu, Langfang (CN); Guiqing Hao, Langfang (CN); Wanguang Song, Langfang (CN); Zichao Ii, Langfang (CN); Yanmin Zhou, Langfang (CN)

(73) Assignees: China National Offshore Oil Corporation, Beijing (CN); China Oilfield Services Limited, Sanhe, Langfang, Hebei (CN)

( * ) Notice: Subject to any disclaimer, the term of this patent is extended or adjusted under 35 U.S.C. 154(b) by 547 days.

(21) Appl. No.: 14/888,454

(22) PCT Filed: May 21, 2014

(86) PCT No.: PCT/CN2014/077997
§ 371 (c)(1),
(2) Date: Nov. 2, 2015

(87) PCT Pub. No.: WO2015/131449
PCT Pub. Date: Sep. 11, 2015

(65) Prior Publication Data

US 2016/0362977 A1 Dec. 15, 2016

(30) Foreign Application Priority Data

Mar. 4, 2014 (CN) ..... 2014 1 0077215

(51) Int. Cl.
*E21B 49/08* (2006.01)
*E21B 49/10* (2006.01)
(Continued)

(52) U.S. Cl.
CPC ..... *E21B 49/083* (2013.01); *E21B 4/04* (2013.01); *E21B 34/066* (2013.01); *E21B 47/06* (2013.01); *E21B 49/10* (2013.01)

(58) Field of Classification Search
CPC ..... E21B 4/04; E21B 34/066; E21B 47/06; E21B 49/083; E21B 49/10
See application file for complete search history.

(56) References Cited

U.S. PATENT DOCUMENTS 4,860,581 A * 8/1989 Zimmerman ..... E21B 49/081 175/50
4,936,139 A * 6/1990 Zimmerman ..... E21B 49/08 175/40
(Continued)

FOREIGN PATENT DOCUMENTS

CN 1333459 A 1/2002
CN 1869400 A 11/2006
(Continued)

OTHER PUBLICATIONS

New Method of Downhole Fluid Sampling and Analysis; Ridvan Akkurt et al.

*Primary Examiner* — Matthew R Buck
(74) *Attorney, Agent, or Firm* — Ling Wu; Stephen Yang; Ling and Yang Intellectual Property

(57) ABSTRACT

A system of formation sampling while drilling, comprising: a suction pup joint provided to pump out and clean the formation fluid; a sampling pup joint provided to sample and store the formation fluid; a setting pup joint provided between the suction pup joint and the sampling pup joint and provided to establish a fluid channel between the formation
(Continued)

fluid and the suction pup joint, the sampling pup joint; and an electrohydraulic high voltage connection device provided between the setting pup joint and the sampling pup joint. The embodiments of the present invention can be applied in the field of formation exploration technology, the function of storing the formation sample in the process of logging while drilling can be accomplished and the current logging instrument can be effectively optimized, the universality and precision of the current logging function can be effectively improved according to the embodiments of the present invention.

12 Claims, 2 Drawing Sheets

(51) Int. Cl.

| | |
|---|---|
| ***E21B 4/04*** | (2006.01) |
| ***E21B 34/06*** | (2006.01) |
| ***E21B 47/06*** | (2012.01) |

(56) References Cited

U.S. PATENT DOCUMENTS

| | | | | |
|---|---|---|---|---|
| 5,056,595 | A | 10/1991 | Desbrandes | |
| 5,377,755 | A | 1/1995 | Michaels et al. | |
| 5,934,374 | A * | 8/1999 | Hrametz | E21B 49/10 166/100 |
| 6,301,959 | B1 * | 10/2001 | Hrametz | E21B 33/1243 166/250.17 |
| 6,719,049 | B2 * | 4/2004 | Sherwood | E21B 49/10 166/252.5 |
| 7,128,144 | B2 * | 10/2006 | Fox | E21B 49/10 166/100 |
| 7,263,881 | B2 * | 9/2007 | Ramakrishnan | E21B 49/10 73/152.55 |
| 7,857,049 | B2 * | 12/2010 | Sherwood | E21B 49/10 166/100 |
| 8,235,106 | B2 * | 8/2012 | Fox | E21B 49/10 166/100 |
| 8,453,725 | B2 | 6/2013 | Brennan, III | |
| 2006/0000603 | A1 | 1/2006 | Zazovsky et al. | |
| 2007/0018848 | A1 | 1/2007 | Bottos et al. | |
| 2008/0314137 | A1 * | 12/2008 | Proett | E21B 49/10 73/152.22 |
| 2009/0195250 | A1 * | 8/2009 | Welshans | E21B 17/16 324/324 |
| 2014/0338900 | A1 * | 11/2014 | Jones | E21B 49/10 166/264 |

FOREIGN PATENT DOCUMENTS

| | | | |
|---|---|---|---|
| CN | 200941500 | Y | 8/2007 |
| CN | 101575971 | A | 11/2009 |
| CN | 101644154 | A | 2/2010 |
| CN | 101896684 | A | 11/2010 |
| CN | 202039843 | U | 11/2011 |
| CN | 102597422 | A | 7/2012 |
| CN | 202302433 | U | 7/2012 |
| CN | 102808616 | A | 12/2012 |
| CN | 103151666 | A | 6/2013 |
| MX | 201100050 | A | 6/2011 |
| WO | 2007146801 | A2 | 12/2007 |

* cited by examiner

SYSTEM FOR SAMPLING FROM FORMATION WHILE DRILLING

TECHNICAL FIELD

The embodiments of the present invention relate to the field of formation exploration technology, in particular to a system of formation sampling while drilling.

BACKGROUND OF THE RELATED ART

At present, with the improvement of exploration technology level, logging while drilling technology applied in the formation is also rapidly developed. Wherein, logging while drilling technology can not only measure the wells in any cases, in particular the horizontal wells, but also timely adjust a bit track using the measured drilling parameter and formation parameter so as to drill along the direction of a target layer. Since the formation parameter obtained from the logging while drilling is the newly drilled formation parameter, it is closest to the initial state of the formation and used for evaluating the oil-containing and gas-containing in the complex formation, which is more advantageous than the ordinary wireline logging. The instrument of logging while drilling is placed within the drill collar, and the drilling parameters such as the drilling pressure, torque, rotational speed, annular pressure, temperature, chemical components are also measured in addition to the electrical resistivity, sound velocity, neutron porosity and density of the conventional logging and some imaging logging and the like. However, the function of formation sampling cannot be accomplished by the current logging while drilling technology at home and abroad; correspondingly, there is no mature formation sampling apparatus at home and abroad; the specific condition of the explored formation cannot be precisely judged by the current logging apparatus and the false judgment cannot be effectively avoided due to the experience and the empirical data used in the actual operation, which cannot preferably satisfy the production needs.

CONTENT OF THE INVENTION

The embodiment of the present invention provides a system of formation sampling while drilling comprising:

a suction pup joint provided to pump out and clean the formation fluid;

a sampling pup joint provided to sample and store the formation fluid;

a setting pup joint provided between the suction pup joint and the sampling pup joint and provided to establish a fluid channel between the formation fluid and the suction pup joint, the sampling pup joint; and an electrohydraulic high voltage connection device provided between the setting pup joint and the sampling pup joint.

The above system of formation sampling while drilling can further comprise the following feature:

a control circuit being provided inside of the suction pup joint and the sampling pup joint, and the control circuit being provided to control the operation of pumping out and cleaning of the suction pup joint and the operation of sampling and storing of the sampling pup joint.

The above system of formation sampling while drilling can further comprise the following features:

the setting pup joint being provided with a setter and a pressure sensor;

one end of the setter being provided inside of the formation, and the other end of the setter being connected to the setting pup joint; and the setter being provided to establish a channel inlet of the fluid channel and isolate the mud in the wellbore;

the pressure sensor being provided on the fluid channel and provided to detect the fluid pressure in the fluid channel.

The above system of formation sampling while drilling can further comprise the following features:

the suction pup joint being provided with a first electric motor, a first piston cylinder and a first electromagnetic valve in the interior thereof which are connected;

the first electric motor being provided to supply operation power of pumping out and cleaning to the suction pup joint.

The above system of formation sampling while drilling can further comprise the following features:

the sampling pup joint being provided with a second electric motor, a second piston cylinder, a second electromagnetic valve and a sample storage room in the interior thereof which are connected;

the second electric motor being provided to supply operation power of sampling and storing to the sampling pup joint.

The above system of formation sampling while drilling can further comprise the following feature:

the second piston cylinder is a two-way piston cylinder.

The above system of formation sampling while drilling can further comprise the following features:

the setting pup joint further comprising an adjusting nipple, an adapter and a flow channel conversion joint which are connected in sequence, and the adjusting nipple and the flow channel conversion joint being both connected with a standard instrument joint;

the adapter and the adjusting nipple being provided to establish a circuit path between the setting pup joint and the standard instrument.

The above system of formation sampling while drilling can further comprise the following features:

the electrohydraulic high voltage connection device being a 12-core slip ring, and the 12-core slip ring being provided to simultaneously establish a circuit path and a liquid connection path between the setting pup joint and the sampling pup joint, the sample reaching the sampling pup joint by the liquid connection path.

The above technical schemes of the present invention have the following beneficial effects:

a system of formation sampling of logging while drilling instrument, the operation of controlling the use of the formation fluid by the control circuit according to the condition of the formation fluid, the storing function while drilling of the formation sample achieving the function of logging while drilling, and the effective optimizing of current logging instrument are accomplished by the suction pup joint provided to pump out and clean the formation fluid, the sampling pup joint provided to sample and store the formation fluid, the setting pup joint provided to establish the fluid channel between the formation fluid and suction pup joint, sampling pup joint, and the electrohydraulic high voltage connection device provided between the setting pup joint and the sampling pup joint; the universality and precision of the current logging function can be effectively improved by the corresponding control action of the control circuit, respective electromagnetic valves and the pressure sensor; meanwhile, the above structure is modular combination and the functions of respective modules are independent from each other, which facilitates the wellhead assembly on site operation and effectively improve the efficiency of the preparation for logging operation.

The other features and advantages of the present invention will be illustrated in the subsequent embodiments and become partially obvious from the embodiments, or be understood by implementing the embodiment of the present invention. The object and other advantages of the present invention can be implemented and obtained from the structure specifically pointed out in the description, the claims and the drawings.

BRIEF DESCRIPTION OF DRAWINGS

Drawings are used for further understanding of the technical schemes of the present invention and constitute a part of the description, are used for explaining the technical schemes of the invention in combination with the embodiments of the invention, not for limit the technical schemes of the invention.

PREFERRED EMBODIMENTS OF THE PRESENT INVENTION

The embodiments of the present invention will be described in detail below in conjunction with accompanying drawings. It should be illustrated that without a conflict, the embodiments in the present application and the features in the embodiments can be combined with each other randomly.

Figure 1:
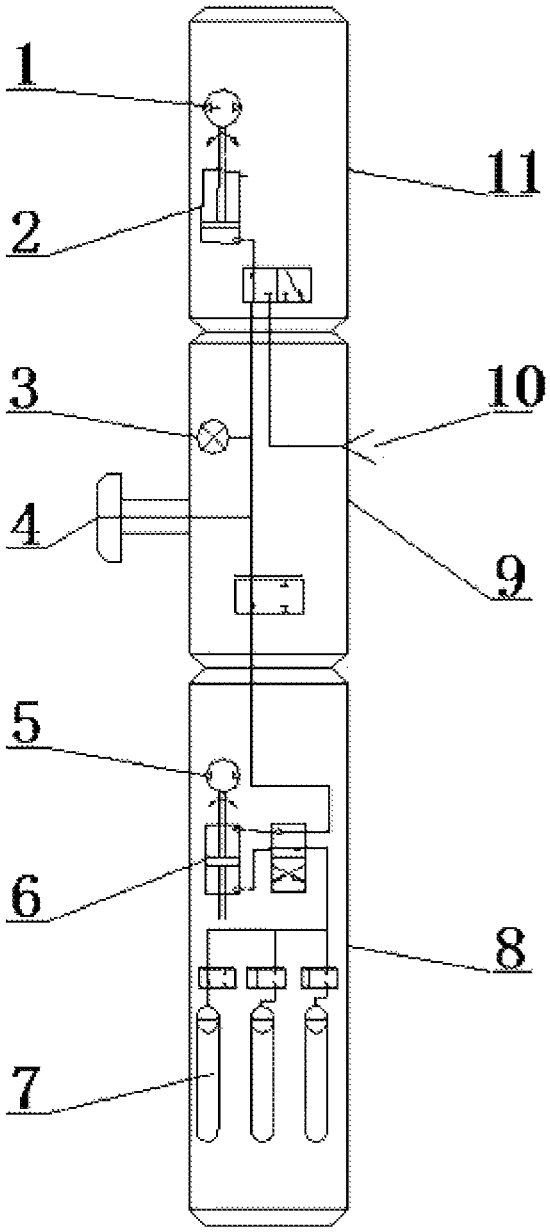
FIG. 1 is a structural diagram according to the embodiments of the present invention.

The embodiment of the present invention provides a system of formation sampling while drilling, as shown in FIG. 1, which may comprise:

a suction pup joint 11 provided to pump out and clean the formation fluid; a sampling pup joint 8 provided to sample and store the formation fluid; a setting pup joint 9 provided between the suction pup joint 11 and sampling pup joint 8 and provided to establish a fluid channel between the formation fluid and the suction pup joint 11, the sampling pup joint 8; an electrohydraulic high voltage connection device provided between the setting pup joint 9 and the sampling pup joint 8.

In the specific operation according to the embodiments of the present invention, the modular design according to the above suction pup joint 11 and sampling pup joint 8 can be applied to the instrument of logging while drilling; and since it can be directly applied to the current apparatus, it has stronger implementation.

Furthermore, in order to improve the collecting efficiency of the formation fluid, preferably, in the specific operation according to the embodiments of the present invention, the control circuit is also correspondingly provided, the control circuit is provided inside the suction pup joint 11 and the sampling pup joint 8 and is provided to control the operation of pumping out and cleaning of the suction pup joint 11 and the operation of sampling and storing of the sampling pup joint 8. Wherein, the setting pup joint 9 can be provided with a setter 4 and a pressure sensor 3;

one end of the setter 4 is provided inside of the formation, the other end of the setter 4 is connected with the setting pup joint 9, the setter 4 is provided to establish a channel inlet of the fluid channel and isolate the mud in the wellbore; the pressure sensor 3 is provided on the fluid channel and to detect the fluid pressure in the fluid channel. In the specific operation according to the embodiments of the present invention, the end of the setter 4 which is pierced into the formation is provided with a rubber port such that the connection between the setter 4 and the formation is a tight connection, which can effectively guarantee the mud in the wellbore and drill collar to flow into the setter 4.

Preferably, in the specific operation according to the embodiments of the present invention, the suction pup joint 11 can be provided with a first electric motor 1, a first piston cylinder 2 and a first electromagnetic valve in the interior thereof which are connected; wherein the first electric motor 1 can be provided to supply the operation power of pumping out and cleaning to the suction pup joint 11. Correspondingly, the sampling pup joint 8 can be provided with a second electric motor 5, a second piston cylinder 6, a second electromagnetic valve and a sample storage room 7 in the interior thereof which are connected; the second electric motor 5 can be provided to supply operation power of sampling and storing to the sampling pup joint 8. Preferably, the second piston cylinder 6 is a two-way piston cylinder. The independence between the suction pup joint 11 and the sampling pup joint 8 can be accomplished by the first electric motor 1 and the second electric motor 5, i.e., the suction pup joint 11 and the sampling pup joint 8 respectively use two sets of independent power systems such that the functions of sucking and sampling are completely independent from each other without being influenced; and meanwhile, the three pup joints can be butted with the wellhead.

In the specific operation according to the embodiments of the present invention, the corresponding action can be performed by controlling the first electric motor 1, the second electric motor 5, the first electromagnetic valve and the second electromagnetic valve via the control circuit; it needs to be pointed out that the specific control operation by the control circuit belongs to the conventional technical means in the art, and the specific control process will not be described here.

The specific operation according to the embodiments of the present invention can be accomplished by the following operation procedure:

1. The setter 4 is protruded from the setting pup joint 9 and pierced into the formation to establish a channel between the formation fluid and the system of sample suction and sampling and at the same time, isolate the channel of the mud in the wellbore with the whole system.

2. The suction pup joint 11 starts to operate, the first electric motor 1 drives the first piston cylinder 2 to extract the formation liquid, and at the same time, the pressure sensor 3 starts to measure the pressure of the sample. The original mud in the sample channel can be completely discharged from an outer outlet 10 by the multiple suctions and excretions of the suction pup joint 11.

3. When the sampling pup joint 8 is under operation, the second electric motor 5 drives the second piston cylinder 6 to operate and deliver the sample to the sample storage room 7 by the reversing action of the second electromagnetic valve.

Furthermore, in order to further improve the technical effect of the modular configuration of respective composed pup joints according to the embodiments of the present invention, preferably, in the specific operation according to the embodiments of the present invention, the setting pup joint 9 can selectively comprise an adjusting nipple, an adapter and a flow channel conversion joint which are connected in sequence, the adjusting nipple and the flow channel conversion joint are both connected with a standard instrument joint; wherein the adapter and the adjusting nipple are provided to establish a circuit path between the setting pup joint 9 and the standard instrument. The electrohydraulic high voltage connection device can be a 12-core slip ring, and the 12-core slip ring is provided to simultaneously establish a circuit path and a liquid connection path between the setting pup joint 9 and the sampling pup joint 8, and the sample reaches the sampling pup joint 8 by the liquid connection path.

Figure 2:
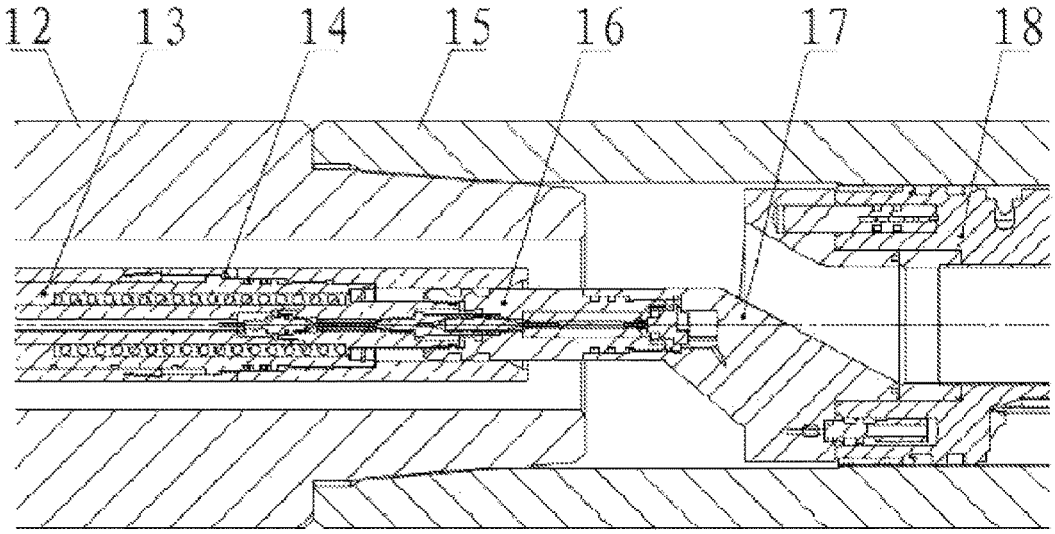
FIG. 2 is a diagram of abutting configuration according to the embodiments of the present invention.

The standard instrument joint is shown in FIG. 2, the connection outside the drill collar is the cooperation connection of an outer threaded end 12 and the inner threaded end 15; wherein an adjusting nipple 14 is provided in a pin end 13 of the drill collar, a flow channel conversion joint 17 is provided in a box end of the drill collar by an electronic framework 18, and an adapter 16 is provided between the adjusting nipple 14 and the flow channel conversion joint 17; an corresponding circuit path can be established by the adapter 16 and the adjusting nipple 14.

The compatibility of the setting pup joint 9 and a connection interface of standard drill collar wellhead can be accomplished by the above flow channel conversion joint according to the embodiments of the present invention; a sample delivery channel between the setting pup joint 9 and the sampling pup joint 8 can be accomplished by the above 12-core slip ring; and in the specific operation, the customers may select the corresponding connection structure according to their needs; and the application scope in the specific operation according to the embodiments of the present invention can be effectively expanded.

The function of storing the formation sample while drilling in the process of logging while drilling can be accomplished and the current logging instrument can be effectively optimized by the above system of formation sampling while drilling according to the embodiments of the present invention; the universality and precision of the current logging function are effectively improved by the corresponding control action of the control circuit, respective electromagnetic valves and the pressure sensor 3; meanwhile, the above structure is modular combination and the function of respective module is independent from each other, which facilitates the wellhead assembly on site operation, effectively improves the efficiency of the preparation for logging operation, and easy to be promoted and implemented.

Those skilled in the art should understand that although the embodiments disclosed in the present invention are as the above, the described contents are the embodiments used only for the ease of understanding of the present invention, instead of limiting the present invention. Anyone skilled in the art, under the premise of without deviating from the spirit and scope of the disclosure of the embodiments of the present invention, may make any change and variation in the form and details of implementation. The patent protection scope of the present invention should still be based on the scope defined by the appended claims.

INDUSTRIAL APPLICABILITY

The embodiments of the present invention can be applied in the field of formation exploration technology, the function of storing the formation sample in the process of logging while drilling can be accomplished and the current logging instrument can be effectively optimized, the universality and precision of the current logging function are effectively improved according to the embodiments of the present invention; the function of respective module is independent from each other, and it is easy to assemble the wellhead assembly on site operation, thus the efficiency of the preparation for logging operation can be effectively improved.

What is claimed is:

1. A system of formation sampling while drilling comprising:

a suction pup joint provided to pump out and clean formation fluid;

a sampling pup joint provided to sample and store the formation fluid;

a setting pup joint provided between the suction pup joint and the sampling pup joint and provided to establish a fluid channel between the formation fluid, the suction pup joint and the sampling pup joint; and an electrohydraulic high voltage connection device provided between the setting pup joint and the sampling pup joint, wherein the suction pup joint is provided with a first electric motor, a first piston cylinder and a first electromagnetic valve in the interior thereof which are connected, the first electric motor being provided to supply operation power of pumping out and cleaning to the suction pup joint, and wherein the sampling pup joint is independent of the suction pup joint and provided with a second electric motor, a second piston cylinder, a second electromagnetic valve and a sample storage room in the interior thereof which are connected, the second electric motor being provided to supply operation power of sampling and storing to the sampling pup joint.

2. A system of formation sampling while drilling according to claim 1, further comprising:

a control circuit provided inside of the suction pup joint and the sampling pup joint, the control circuit being provided to control the operation of pumping out and cleaning of the suction pup joint and the operation of sampling and storing of the sampling pup joint.

3. A system of formation sampling while drilling according to claim 1, wherein, the setting pup joint is provided with a setter and a pressure sensor;

the setter is provided inside of the formation at one end thereof, and the setter is connected with the setting pup joint at the other end thereof; and the setter is provided to establish a channel inlet of the fluid channel and isolate the mud in a wellbore;

the pressure sensor is provided on the fluid channel and provided to detect the fluid pressure in the fluid channel.

4. A system of formation sampling while drilling according to claim 1, wherein, the second piston cylinder of the sampling pup joint is a two-way piston cylinder.

5. A system of formation sampling while drilling according to claim 1, wherein, the setting pup joint further comprises an adjusting nipple, an adapter and a flow channel conversion joint which are connected in sequence, and the adjusting nipple and the flow channel conversion joint are both connected with a standard instrument joint;

the adapter and the adjusting nipple are provided to establish a circuit path between the setting pup joint and a standard instrument.

6. A system of formation sampling while drilling according to claim 1, wherein, the electrohydraulic high voltage connection device is a 12-core slip ring, and the 12-core slip ring is provided to simultaneously establish a circuit path and a liquid connection path between the setting pup joint and the sampling pup joint.

7. A system of formation sampling while drilling according to claim 2, wherein, the setting pup joint further comprises an adjusting nipple, an adapter and a flow channel conversion joint which are connected in sequence, and the adjusting nipple and the flow channel conversion joint are both connected with a standard instrument joint;

the adapter and the adjusting nipple are provided to establish a circuit path between the setting pup joint and a standard instrument.

8. A system of formation sampling while drilling according to claim 3, wherein, the setting pup joint further comprises an adjusting nipple, an adapter and a flow channel conversion joint which are connected in sequence, and the adjusting nipple and the flow channel conversion joint are both connected with a standard instrument joint;

the adapter and the adjusting nipple are provided to establish a circuit path between the setting pup joint and a standard instrument.

9. A system of formation sampling while drilling according to claim 4, wherein, the setting pup joint further comprises an adjusting nipple, an adapter and a flow channel conversion joint which are connected in sequence, and the adjusting nipple and the flow channel conversion joint are both connected with a standard instrument joint;

the adapter and the adjusting nipple are provided to establish a circuit path between the setting pup joint and a standard instrument.

10. A system of formation sampling while drilling according to claim 2, wherein, the electrohydraulic high voltage connection device is a 12-core slip ring, and the 12-core slip ring is provided to simultaneously establish a circuit path and a liquid connection path between the setting pup joint and the sampling pup joint.

11. A system of formation sampling while drilling according to claim 3, wherein, the electrohydraulic high voltage connection device is a 12-core slip ring, and the 12-core slip ring is provided to simultaneously establish a circuit path and a liquid connection path between the setting pup joint and the sampling pup joint.

12. A system of formation sampling while drilling according to claim 4, wherein, the electrohydraulic high voltage connection device is a 12-core slip ring, and the 12-core slip ring is provided to simultaneously establish a circuit path and a liquid connection path between the setting pup joint and the sampling pup joint.

* * * * *